United States Patent [19]

Hoff

[11] 4,360,795

[45] Nov. 23, 1982

[54] DETECTION MEANS

[75] Inventor: Dave Hoff, Brooklyn Park, Minn.

[73] Assignee: Honeywell, Inc., Minneapolis, Minn.

[21] Appl. No.: 193,869

[22] Filed: Oct. 3, 1980

[51] Int. Cl.[3] ..... G08G 1/01; G08G 1/04

[52] U.S. Cl. ..... 340/38 R; 340/38 S; 340/566; 367/126

[58] Field of Search ..... 340/34, 38 R, 23, 27 R, 340/38 S, 32, 566; 367/93, 126, 906

[56] References Cited

U.S. PATENT DOCUMENTS

| | | | |
|---|---|---|---|
| 2,965,893 | 12/1960 | Barker | 340/38 R |
| 3,258,762 | 6/1966 | Donner | 340/38 R |
| 3,341,810 | 9/1967 | Wallen | 367/906 |
| 3,573,724 | 4/1971 | Komorida | 340/38 R |
| 3,895,344 | 7/1975 | Gill et al. | 340/38 S |
| 4,223,304 | 9/1980 | Barowitz et al. | 340/566 |

FOREIGN PATENT DOCUMENTS

| | | | |
|---|---|---|---|
| 2738811 | 4/1978 | Fed. Rep. of Germany | 340/23 |

*Primary Examiner*—James J. Groody

*Attorney, Agent, or Firm*—Roger W. Jensen

[57] ABSTRACT

An apparatus for determining the time of the closest point of approach of a taxiing aircraft comprising a microphone means for producing an input signal in response to the sound energy of a taxiing jet. A low pass filter is provided to receive the input signal and pass low signals having a frequency less than or equal to 1 KHZ while a high pass filter is provided to receive the input signal and pass high signals having a frequency greater than or equal to 1.5 KHZ. Demodulators are provided for receiving the signals from both the high and low pass filters, and are adapted to produce a low frequency envelope from the low signal and a high frequency envelope from the high signal. Finally, comparator apparatus is provided for receiving the low frequency envelope and the high frequency envelope and comparing the amplitudes so as to provide a signal at the point in time when the amplitude of the low frequency envelope exceeds the amplitude of the high frequency envelope. This signal indicates in real time the point of closest approach of a taxiing jet aircraft.

4 Claims, 2 Drawing Figures

DETECTION MEANS

BACKGROUND OF THE INVENTION

There are a wide variety of applications where it is of interest to know the real time when a particular event happens. For example, it is often times desirable to know the precise point in time when a jet aircraft is closest to a given spot on the runway.

U.S. Pat. No. 3,573,724 relates to a traffic flow detecting apparatus wherein the level of noise is compared to a reference level for determining traffic. U.S. Pat. No. 3,383,652 discloses an apparatus for determining the trajectory of aircraft involving the use of a track and a plurality of crushable detection elements. This system depends upon taxiing aircraft actually impacting on a detection element.

Other methods are proposed, such as the placement of a speaker as set forth in U.S. Pat. No. 3,855,571 which includes a loudspeaker mounted on each airplane for transmission of a coded high frequency acoustic signal while the plane is on the ground. That system is totally ineffective when one does not have control over the airplane's being detected. Finally, devices have been employed to listen to a jet engine to determine possible engine malfunctions and abnormal conditions. U.S. Pat. No. 3,315,522 discloses an engine sonic analyzer system for detecting mechanical faults and rotating parts of a high speed engine.

At the present time, however, no system exists which permits remote recognition of the approach of an aircraft for the purpose of determining the point in time when the aircraft is closest to a given point on the airfield.

BRIEF DESCRIPTION OF THE INVENTION

It has now been discovered that the time of the closest point of approach of a taxiing jet aircraft to a given place can be determined using the following apparatus. A microphone is provided for producing an input signal in response to the sound energy of a jet aircraft. A jet aircraft emits sound energy in two distinct frequency bands. One band is a low frequency band less than or equal to 1 KHZ and the other is a high frequency band greater than or equal to 1.5 KHZ. The low frequency band is generated by the exhaust roar of the jet, while the high frequency band is generated by the whine of the jet turbine blades.

The apparatus includes low pass filter means adapted to receive the input signal and pass low signals having a frequency less than or equal to 1 KHZ. Also provided are high pass filter means adapted to receive the input signal and pass high signals having a frequency greater than or equal to 1.5 KHZ.

Demodulator means are provided for receiving the outputs of the high pass filter and the low pass filter, the demodulator means being adapted to produce a low frequency envelope from the low signal and a high frequency envelope from the high signal. Comparator means are then provided for receiving the low frequency envelope and the high frequency envelope. The comparator means is adapted to provide a signal at the point in time when the amplitude of the low frequency envelope exceeds the amplitude of the high frequency envelope. At this point of time, the aircraft has approached its closest point to the location of the microphone means.

In a preferred embodiment, the demodulator means being a full wave detector with an averaging circuit for each of the low pass filter signals and high pass filter signals, typical time constants for the averaging circuit are approximately 0.6 second for both the low pass filter signal and the high pass filter signal averaging circuit. In a preferred embodiment, the comparator means further includes enabling means for activating the comparator at that point in time when the difference signal (high frequency envelope minus the low frequency envelope) exceeds a predetermined threshold. This enabling signal is latched for approximately 5 second after the signal once again falls below the preset threshold.

DESCRIPTION OF THE PREFERRED EMBODIMENT

For a more complete understanding of the invention, reference is hereby made to the drawings, in which.

Figure 1:
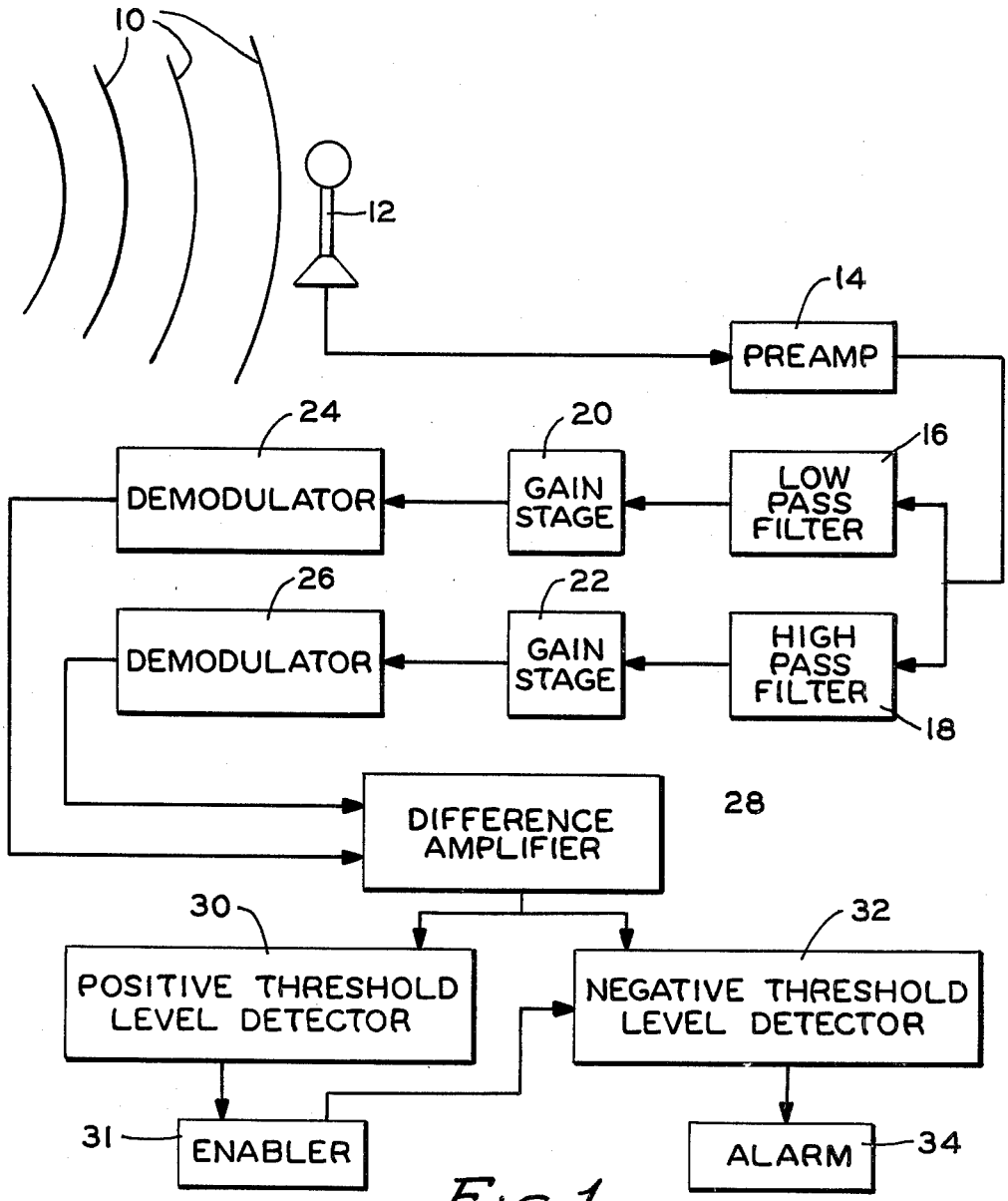
FIG. 1 is a schematic showing the operation of the present invention.

As shown in FIG. 1, sound energy 10 comes from a jet aircraft and is picked up by broad band omnidirectional acoustic pressure microphone 12 for transmission to a pre-amplifier 14. The signal is then divided into two frequency bands by a high pass filter 18 and a low pass filter 16. High pass filter 18 is designed to pass frequencies equal to or greater than 1.5 KHZ and represents the sound generated by the whine of the jet turbine blades. Low pass filter 16 passes a frequency band less than or equal to 1 KHZ, which is generated by the exhaust roar of the jet itself. Both frequency bands are amplified by gain stages 20 and 22 to a level proper for driving a pair of demodulators 24 and 26. The demodulators consist of a full wave detector with an averaging circuit. The averaging time constant is 0.6 second.

In the preferred embodiment, the high and low frequency envelopes signals from demodulators 24 and 26 are applied to a difference amplifier 28 with the resultant signal being the high frequency envelope minus the low frequency envelope.

The output of the difference amplifier 28 is fed into a positive threshold level detector 30 which in turn activates an enable latch 31 for a preset period time; a preferred period is about 5 seconds for mid period of time. The output of the difference amplifier 28 is also fed into a negative threshold level detector 32, which is capable of providing a signal to alarm 34 when both the negative threshold and the enable signal are present. When such a signal is given, the point in time when the jet aircraft has reached its closest point of approach to the microphone has occurred.

Figure 2:
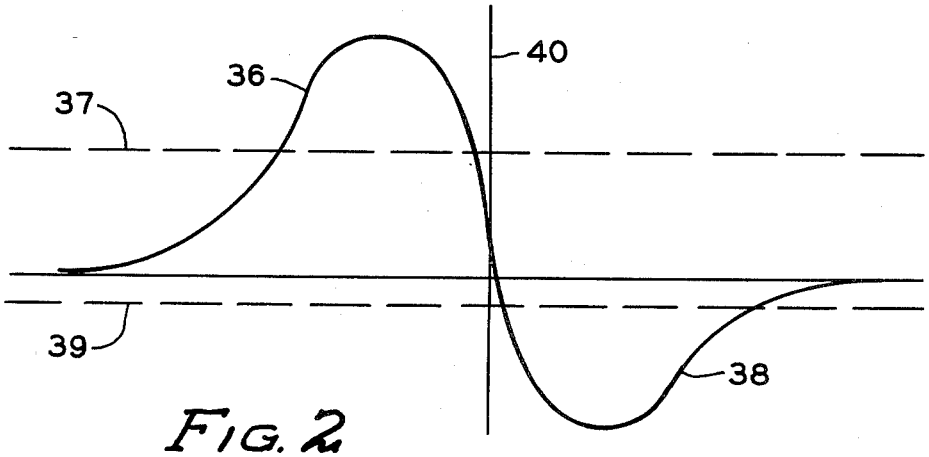
FIG. 2 represents the output of the device shown in FIG. 1 indicating the point in time of closest point of approach.

As shown in FIG. 2, the line 36 indicates the difference signal generated by the difference amplifier 28 when the aircraft is approaching. The high frequency envelope tends to diminish as the aircraft reaches its closest point of approach. At point 40 on FIG. 2, the low frequency envelope has an equal amplitude to the high frequency curve, indicating the point in time when the aircraft has approached the closest point to the microphone. This point in time is indicated by the difference signal passing through zero from positive to negative. Line 38 represents the time when the low frequency envelope exceeds the high frequency envelope. An enable signal from enabler 31 is started when line 36 exceeds positive threshold 37, and remains latch for 5 seconds after line 36 no longer exceeds this threshold while negative threshold line 39 indicates the closest point of approach.

As can be appreciated, the present invention has a wide variety of utility since it can operate over wide frequency ranges, is omnidirectional in operation and is immune to frequency shifts within the frequency band such as is seen when revving an engine. The device has been shown to operate as well on very slow and very fast taxiing aircraft.

Having thus described the invention, what is claimed is:

1. Apparatus for determining the time of the closest point of approach of a taxiing jet aircraft to an observation point, comprising:

microphone means for producing an input signal in response to the sound energy of operating engine noise of a taxiing jet;

low pass filter means adapted to receive said input signal and to provide an output comprising low signals having a frequency less than or equal to 1.0 KHZ;

high pass filter means adapted to receive said input signal and to provide an output comprising high signals having a frequency greater than or equal to 1.5 MHZ;

demodulator means for receiving said output signals from said high pass filter and said low pass filter, said demodulator means being adapted to produce a low frequency envelope from said low signal and a high frequency envelope from said high signal; and comparator means for receiving said low frequency envelope and said high frequency envelope, said comparator means being adapted to provide a signal at the point in time when the amplitude of the low frequency envelope exceeds the amplitude of the high frequency envelope to thus signal the closest point of approach of said taxiing jet aircraft.

2. The apparatus of claim 1 wherein said comparator means further includes a difference amplifier positioned to receive said low frequency envelope and said high frequency envelope and to provide a signal indicative of the difference between the high frequency envelope minus the low frequency envelope, whereby the closest point of approach is identified at the time said comparator means signal passes from positive to negative.

3. The apparatus of claim 1 which further includes a positive threshold level detector and an enabler for receiving said comparator means signal such that said enabler functions for a predetermined period of time after said comparator means signal exceeds said positive threshold level.

4. The apparatus of claim 3 which further includes a negative threshold level detector for receiving said comparator means signal and connected to said enabler, whereby said negative threshold level detector signals an event when said negative threshold level is exceeded by said comparator signal when said enabler is functioning.

* * * * *

UNITED STATES PATENT OFFICE

CERTIFICATE OF CORRECTION

PATENT NO. : 4,360,795

DATED : November 23, 1982

INVENTOR(S) : Dave Hoff

It is certified that error appears in the above-identified patent and that said Letters Patent are hereby corrected as shown below:

Column 3, line 29, after "filter" (both occurrences) insert --means--.

Column 4, line 29, after "comparator" insert --means--.

Signed and Sealed this

Third Day of May 1983

[SEAL]

*Attest:*

GERALD J. MOSSINGHOFF

*Attesting Officer*

*Commissioner of Patents and Trademarks*